US007792474B2

(12) United States Patent
Miyazaki

(10) Patent No.: US 7,792,474 B2
(45) Date of Patent: Sep. 7, 2010

(54) IMAGE FORMING APPARATUS WITH CLEANING MODE

(75) Inventor: Ken Miyazaki, Kanagawa (JP)

(73) Assignee: Konica Minolta Business Technologies, Inc. (JP)

( * ) Notice: Subject to any disclaimer, the term of this patent is extended or adjusted under 35 U.S.C. 154(b) by 272 days.

(21) Appl. No.: 11/947,867

(22) Filed: Nov. 30, 2007

(65) Prior Publication Data

US 2008/0175614 A1 Jul. 24, 2008

(30) Foreign Application Priority Data

Jan. 18, 2007 (JP) ..... 2007-009140

(51) Int. Cl.
*G03G 15/20* (2006.01)

(52) U.S. Cl. ..... 399/327

(58) Field of Classification Search ..... 399/67, 399/68, 327, 71

See application file for complete search history.

(56) References Cited

FOREIGN PATENT DOCUMENTS

| | | |
|---|---|---|
| JP | 9-292803 | 11/1997 |
| JP | 2002-287446 | 10/2002 |
| JP | 2003-270985 | 9/2003 |
| JP | 2004-126426 | 4/2004 |
| JP | 2006-39477 | 2/2006 |
| JP | 2006-154192 | 6/2006 |

*Primary Examiner*—David M Gray
*Assistant Examiner*—Gregory H Curran
(74) *Attorney, Agent, or Firm*—Cantor Colburn LLP

(57) ABSTRACT

An image forming apparatus, including an image forming section, a fixing unit, a memory section and a control section having a cleaning mode, wherein after the sheet is conveyed to the image forming section, the control section controls the image forming section not to form an image on the sheet, and the sheet is conveyed to the fixing unit, after which the control section controls to clean the fixing member by removing remaining toner, and when sheet jamming is caused at the fixing unit while the cleaning mode is practiced, the control section controls the memory section to store at least one characteristic of the sheet that causes the sheet jamming, and when a succeeding cleaning mode is practiced, the control section prohibits selection of the sheet having the characteristic stored in the memory section, and selects the sheet having other characteristics to practice the cleaning mode.

4 Claims, 11 Drawing Sheets

JAM
OCCURRENCE

REMOVING
JAMMED SHEET

CLEANING
(NORMAL)

JAM OCCURRENCE
IN CLEANING

SHEET TYPE

| BASIS WEIGHT | PLAIN PAPER | FINE-QUALITY SHEET | COLOR PAPER | COATED PAPER GL | COATED PAPER ML | COATED PAPER GO | COATED PAPER MO |
|---|---|---|---|---|---|---|---|
| 64-74 g/m$^2$ | 0 | 1 | 0 | 0 | 0 | 0 | 0 |
| 75-80 g/m$^2$ | 0 | 0 | 0 | 0 | 0 | 0 | 0 |
| 81-105 g/m$^2$ | 0 | 0 | 0 | 0 | 0 | 0 | 0 |
| 106-135 g/m$^2$ | 0 | 0 | 0 | 0 | 0 | 0 | 0 |
| 136-162 g/m$^2$ | 0 | 0 | 0 | 0 | 0 | 0 | 0 |
| 163-209 g/m$^2$ | 0 | 0 | 0 | 0 | 0 | 0 | 0 |
| 210-256 g/m$^2$ | 0 | 0 | 0 | 0 | 0 | 0 | 0 |
| 257-300 g/m$^2$ | 0 | 0 | 0 | 0 | 0 | 0 | 0 |

IMAGE FORMING APPARATUS WITH CLEANING MODE

CROSS REFERENCE TO RELATED APPLICATION

This application is based on Japanese Patent Application No. 2007-009140 filed on Jan. 18, 2007 with the Japanese Patent Office, the entire content of which is hereby incorporated by reference.

FIELD OF THE INVENTION

The present invention relates to an image forming apparatus such as copying machine and a printer, and in particular, to control of an image forming apparatus that fixed toner images formed on a sheet through heat and pressure.

BACKGROUND OF THE INVENTION

In the image forming apparatus such as a copying machine and a printer, an exposure is given based on image data, whereby, an electrostatic latent image is formed, and then, the electrostatic latent image is developed to form a toner image, and this toner image is transferred onto a sheet. Then, the sheet is conveyed to a fixing unit where the sheet is interposed by a fixing member composed of a heat roller and a pressure roller to be conveyed, whereby, the toner image is fixed on the sheet.

Incidentally, when a sheet jam is caused on a fixing unit or in the vicinity of the fixing unit in the image forming apparatus like this, there appears a situation where toner which is not fixed yet keeps adhering to the fixing member inside the fixing unit.

Therefore, toner adhering to the fixing member is removed by allowing a fresh sheet to pass through the fixing member and by transferring toner adhering to the fixing member onto the fresh sheet, through operations called a cleaning mode.

Unexamined Japanese Patent Application Publication No. 2003-270,985 (FIG. 1 on the first page) discloses a fixing unit in which a recording material is caused to pass through a nip portion formed by a fixing roller and a pressure member, and the fixing roller is rotated reversely after image forming for a prescribed number of sheets is completed, whereby, cleaning is carried out and toner contamination can be prevented.

Further, Unexamined Japanese Patent Application Publication No. 2006-154,192 (FIG. 1 on the first page) discloses an image forming apparatus in which cleaning is carried out surely and efficiently without intermingled post processing operations, by ejecting a sheet for cleaning that has passed through a fixing unit for cleaning after clearing jam and a sheet on which a toner image is formed to different ejecting portions.

Still further, in Unexamined Japanese Patent Application Publication No. 2002-287,446 (FIG. 1 on the first page) discloses image forming operations for the second sheet and thereafter for the first time after detection of completion of image forming on the first sheet when detecting completion of image forming by providing a sensor for confirming sheet ejection, for preventing occurrence of continuous jam for plural sheets in the case of operating again after clearance of sheet jam, and when operating again after jam clearance accompanying occurrence of sheet jam.

Still further, in Unexamined Japanese Patent Application Publication No. H9-292,803 (FIG. 1 on the first page), there is a description to prohibit printing operations of an apparatus and redoing of cleaning until the moment when the prescribed conditions are satisfied, after doing of cleaning, for the purpose of doing cleaning of a heat fixing unit rationally without any problem, in an image forming apparatus wherein a recording material on which a toner image is formed is brought to a nip portion formed by a heating member and a pressure member, to be interposed and conveyed for heat fixing.

Still further, in Unexamined Japanese Patent Application Publication No. 2004-126,426 (FIG. 1 on the first page), there is a description to clean toner or the like on a roller by conveying a cleaning medium to a fixing unit to be interposed by a nip portion in the course of cleaning, and then, by lowering the conveyance speed of the medium to be lower than the regular conveyance speed in an image forming mode under the condition that the cleaning medium is interposed by the nip portion, and thereby, by causing a fixing roller and a pressure roller to slip on the medium, for the purpose of removing dirt on a rotating body for fixing in a fixing unit simply and effectively, without relying on conventional complicated cleaning mechanism and heat and without requiring disassembly of a fixing unit.

Still further Unexamined Japanese Patent Application Publication 2006-39, 477 (FIG. 1 on the first page) discloses an image forming apparatus having a cleaning mode for repeating two or more times a control step in which a recording material is held in a fixing nip, driving is stopped, the fixing nip is heated and cooled. And then the recording material is conveyed. Said image forming apparatus has a pressing force alternation means for altering a pressing force, and also a pressing force determining means for determining the pressing state. Heating temperature/time, cooling temperature, or an amount of step conveyance in the cooling mode is altered according to the pressing state.

Namely, various types of methods for doing a cleaning mode effectively are described in the respective Patent Document stated above.

However, the inventor of the present invention found out, after keen investigations, that conditions for sheets to be used for cleaning to cause a jam easily still are in existence when doing the cleaning mode of this kind, and a jam is further caused even in the case of cleaning, when sheets which cause a jam easily are used for leaning, to stop an apparatus, resulting in a decline of productivity of an image forming apparatus.

SUMMARY OF THE INVENTION

The invention has been achieved in view of the aforesaid problems, and an object is to realize an image forming apparatus that can control occurrence of sheet jam in practicing a cleaning mode, without declining productivity of an image forming apparatus.

Namely, the inventions of the present patent application solving the aforesaid problems are as follows.

(1) First Invention

An image forming apparatus which forms an image on a sheet, including an image forming section that forms a toner image on a sheet, a fixing unit in which a toner image formed by the image forming section is fixed on a sheet by a fixing member, a memory section that stores characteristics of a sheet, and a control section that controls conveyance of the sheet, wherein the control section has a cleaning mode in which after the sheet is conveyed to the image forming section from a sheet-supplying tray, the control section controls the image forming section not to form an image on the sheet, and controls the sheet to be conveyed to the fixing unit, after which the control section controls the cleaning mode to clean the fixing member by removing toner sticking to the fixing member, and when sheet jamming is caused at the fixing unit while the cleaning mode is practiced, the control section stores at least one characteristic of the sheet that causes the sheet jamming into the memory section, and when a succeeding cleaning mode is practiced, the control section prohibits selection of the sheet having the characteristic stored in the memory section, and selects the sheet having other characteristics to practice the cleaning mode.

(2) Second Invention

An image forming apparatus which forms an image on a sheet, including, an image forming section that forms a toner image on a sheet, a fixing unit in which a toner image formed by the image forming section is fixed on a sheet by a fixing member, a memory section that stores characteristics of a sheet, and a control section that controls conveyance of a sheet, wherein the control section has a cleaning mode in which after the sheet is conveyed to the image forming section from a sheet-supplying tray, the control section controls the image forming section not to form an image on the sheet, and controls the sheet to be conveyed to the fixing unit, after which the control section controls the cleaning mode to clean the fixing member by removing toner sticking to the fixing member, and when sheet jamming is caused at the fixing unit while the cleaning mode is practiced, the control section stores at least one characteristic of the sheet that caused the sheet jamming into the memory section, and when the sheet having the characteristic stored in the memory section is selected, the control section controls the sheet to be conveyed to the fixing unit at a conveyance speed that is lower than a standard conveyance speed.

DETAILED DESCRIPTION OF THE INVENTION

Figure 1:
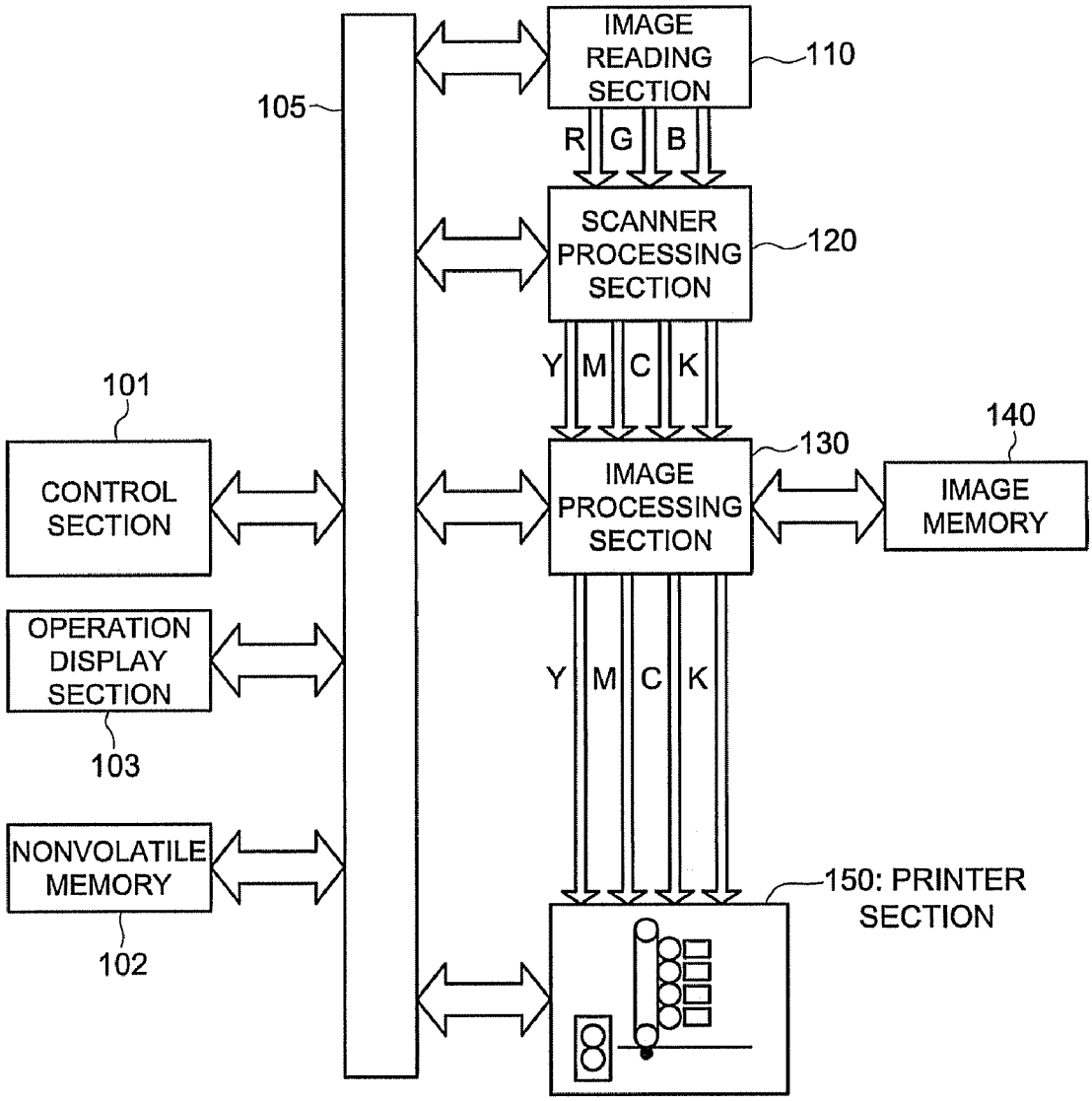
FIG. 1 is a functional block diagram showing an electric structure of an image forming apparatus in the embodiment of the invention.

A preferred embodiment for practicing the invention will be explained in detail as follows, referring to the drawings.

Incidentally, an image forming apparatus in an embodiment of the invention can be applied to any of a copying apparatus equipped with a function to read contents of an object to be copied with a document reading section (scanner) as image information and to copy and a printer having no document reading section (scanner). The invention can be applied also to an imaged forming apparatus such as a multifunctional machine equipped with a facsimile function.

First Embodiment

Structure members of the present embodiment will be explained first, referring to FIG. 1, and then, the mechanical structure of the overall structure of an apparatus to which an image forming apparatus of the embodiment is applied will be explained, referring to FIG. 2.

<Electric Structure of Image Forming Apparatus>

First, electric structures of the image forming apparatus will be explained on a functional basis, referring to FIG. 1. Incidentally, in this case, a specific example of the embodiment is represented by the image forming apparatus wherein images of a document are read in colors (R, G and B) to generate image data, and the image data are subjected to image processing in an image processing section so that an image forming section may practice image forming based on the image data. Further, in this case, an image forming apparatus to conduct image forming with electrophotographic four colors (Y, M, C and K) is used as a specific example.

The image forming apparatus 100 of the present embodiment is composed of control section 101 composed of CPU conducting control of a cleaning mode in addition to control of the overall image forming apparatus, nonvolatile memory 102 that stores various types of established values and various types of logs, operation display section 103 that accepts operations from users and conducts various types of message displays, bus 105 where data giving and receiving are conducted, image reading section 110 that reads a document and generates image data, scanner processing section 120 that conducts necessary processing such as color conversion about image data obtained by the image reading section 110, image processing section 130 that practices various types of image processing necessary for image forming about image data generated by the scanner processing section 120, image memory 140 used for image processing on the image processing section 130 and printer section 150 that conducts image forming of a toner image on a sheet such as a transfer sheet.

Incidentally, in the specific example shown in the present embodiment, image data of RGB are generated through reading of RGB in image reading section 110, and RGB image data are converted into YMCK image data adjusting to colors of image forming at scanner processing section 110, and the invention is not limited to this combination of colors. Namely, the invention may also be one to form a color image using other colors or one for forming a monochrome image.

Figure 2:
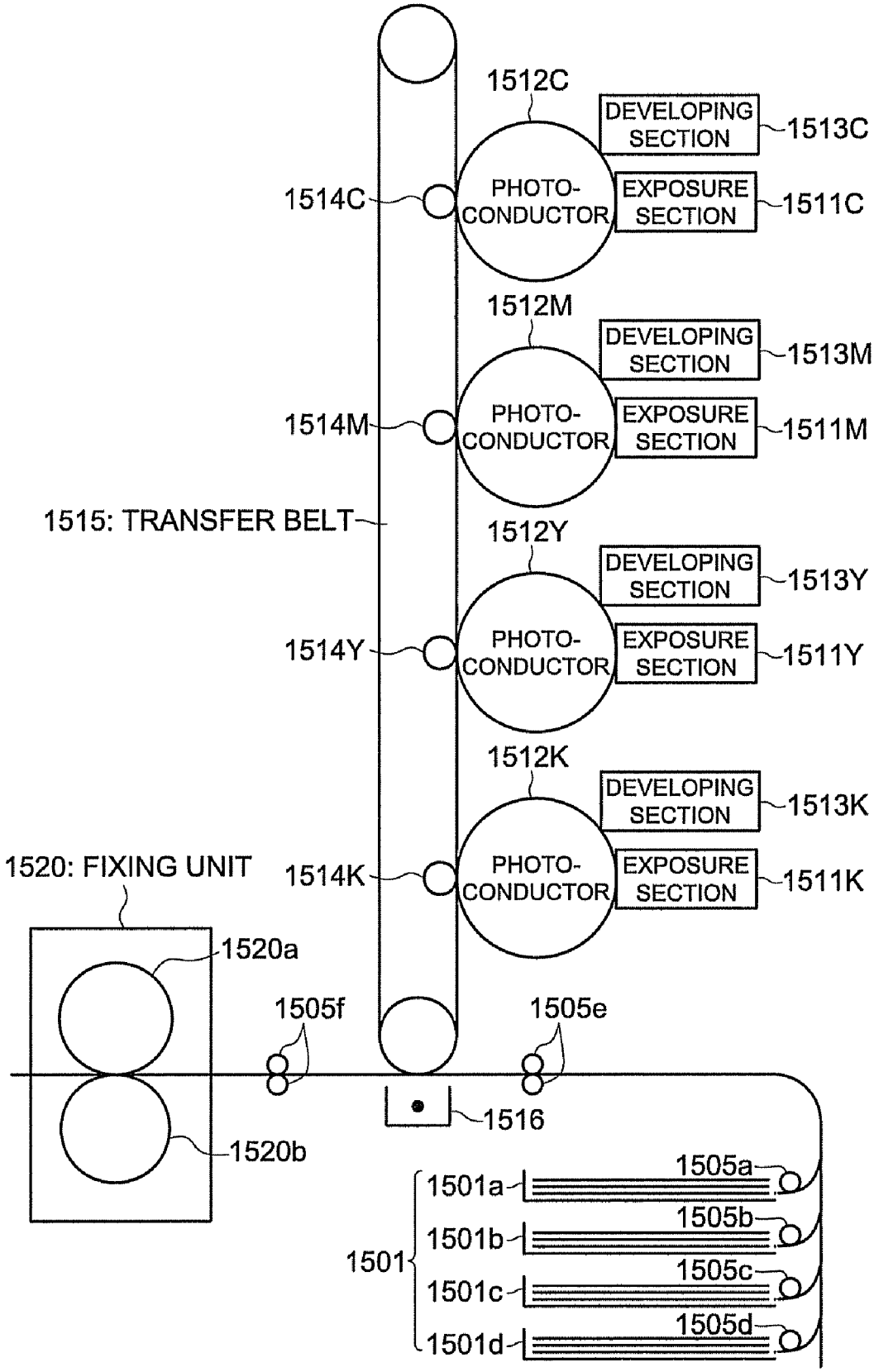
FIG. 2 is a structural diagram showing a mechanical structure of an image forming apparatus in the embodiment of the invention.

Further, printer section 150 is constructed, for example, as shown in FIG. 2. It is composed of sheet-feeding section 1501 wherein various types of sheets are loaded in respective plural trays 1501*a*-1501*d*, first sheet-feeding roller 1505*a*-1505*d* each feeding out sheets from each tray of the sheet-feeding section 1501, second sheet-feeding roller 1505*e* that conveys the sheet fed out to the secondary transfer position at prescribed timing, conveyance roller 1505*f* that conveys the sheet onto which a toner image has been transferred to a fixing unit, exposure section 1511C that conducts exposure corresponding to image data of cyan C, photoconductor 1512C on which an electrostatic latent image is formed after receiving the exposure, developing section 1513C that develops the electrostatic latent image on the photoconductor 1512C to be a toner image, primary transfer section 1514C that transfers a toner image on photoconductor 1512C onto a transfer belt, exposure section 1511M that conducts exposure corresponding to image data of magenta M, photoconductor 1512M on which an electrostatic latent image is formed after receiving the exposure, developing section 1513M that develops the electrostatic latent image on the photoconductor 1512M to be a toner image, primary transfer section 1514M that transfers a toner image on the photoconductor 1512M onto a transfer belt, exposure section 1511Y that conducts exposure corresponding to image data of yellow Y, photoconductor 1512Y on which an electrostatic latent image is formed after receiving the exposure, developing section 1513Y that develops the electrostatic latent image on the photoconductor 1512Y to be a toner image, primary transfer section 1514Y that transfers a toner image on the photoconductor 1512Y onto a transfer belt, exposure section 1511K that conducts exposure corresponding to image data of black K, photoconductor 1512K on which an electrostatic latent image is formed after receiving the exposure, developing section 1513K that develops the electrostatic latent image on the photoconductor 1512K to be a toner image, primary transfer section 1514K that transfers a toner image on the photoconductor 1512K onto a transfer belt, transfer belt 1515 on which the toner images of respective colors are transferred under the registered condition, secondary transfer section 1516 where the toner image on transfer belt 1515 is transferred onto a sheet secondarily, and fixing unit 1520 that conducts heat fixing of the toner image by interposing and conveying the sheet on which the toner image is secondary-transferred while applying heat and pressure with fixing rollers 1520*a* and 1521*b*.

Incidentally, the image forming section is composed of exposure sections 1511C-1511K, developing sections 1513C-1513K, photoconductors 1512C-1512K, primary transfer sections 1514C-1514K, transfer belt 1515 and secondary transfer section 1516.

Further, fixing unit 1520 has a fixing member that is composed of fixing roller 1520*a* and pressure roller 1520*b*.

The fixing member may also be a belt, without being limited to the roller.

Further, in the resent embodiment, various types of exposure devices such as a laser diode or LED can be used as exposure sections 1511C-1511K.

Explanation of Operations of the Present Embodiment

Figure 3:
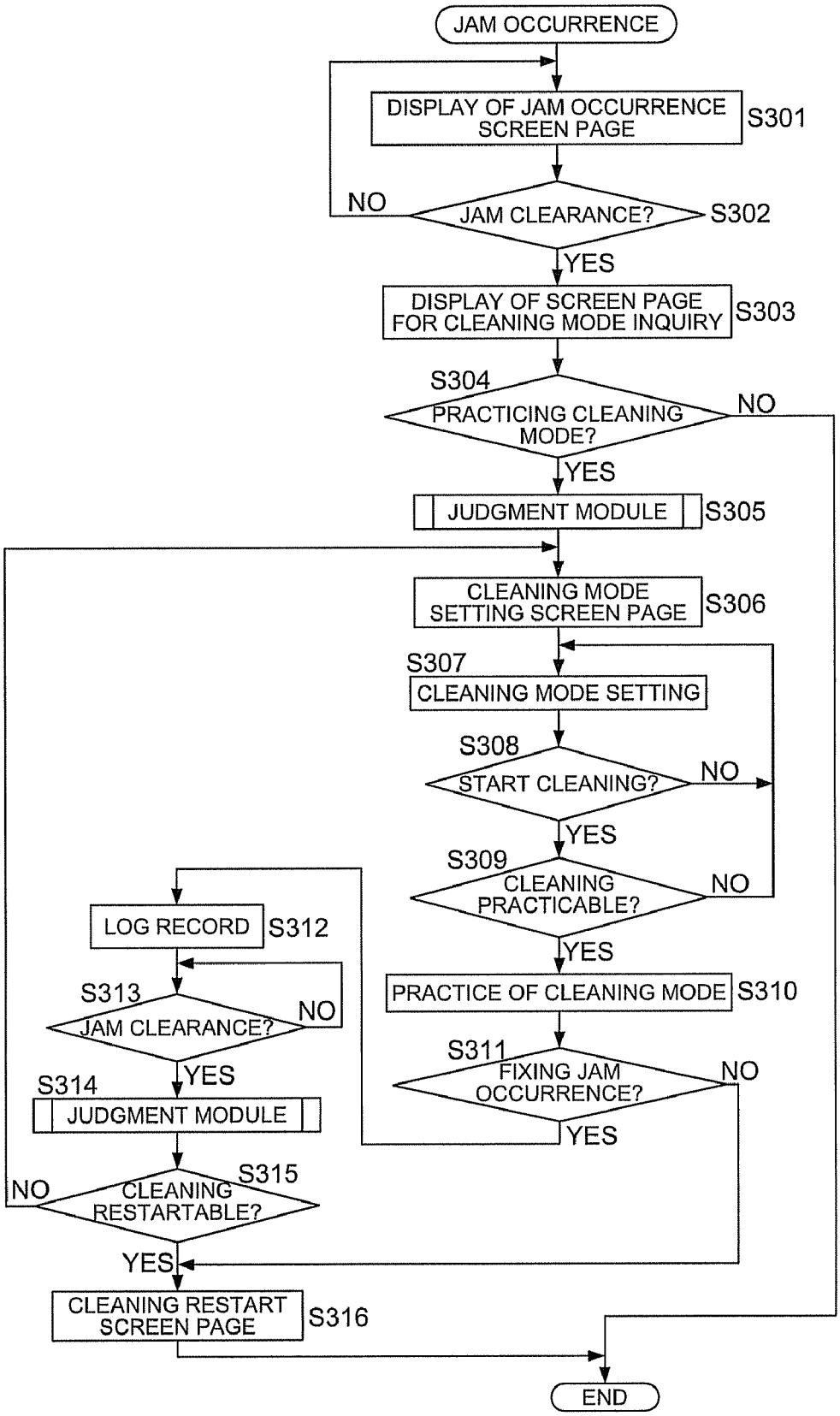
FIG. 3 is a flow chart showing operations of an image forming apparatus in the embodiment of the invention.

In the image forming apparatus of the aforesaid type, when a jam takes place on or in the vicinity of fixing unit 1520, there is practiced a jam clearance program shown by a flow chart in FIG. 3, in an image forming program carried out by control section 101

Figure 5:
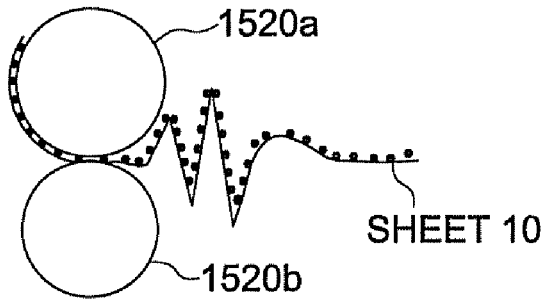
FIGS. 5(*a*)-5(*d*) are illustration diagrams showing operations of an image forming apparatus in the embodiment of the invention.
Figure 5:
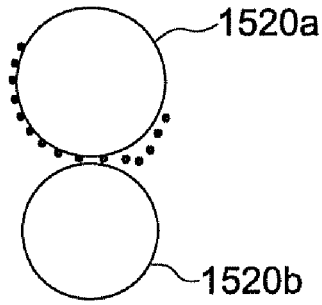
Figure 5:
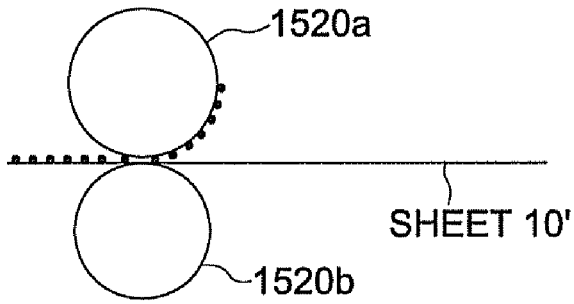
Figure 5:
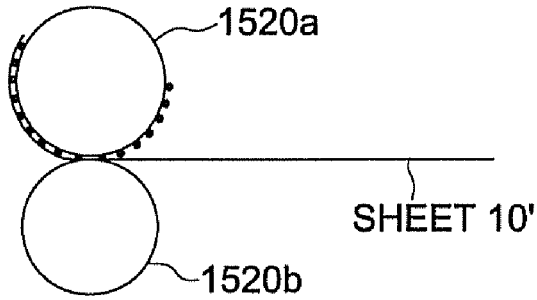
Figure 6:
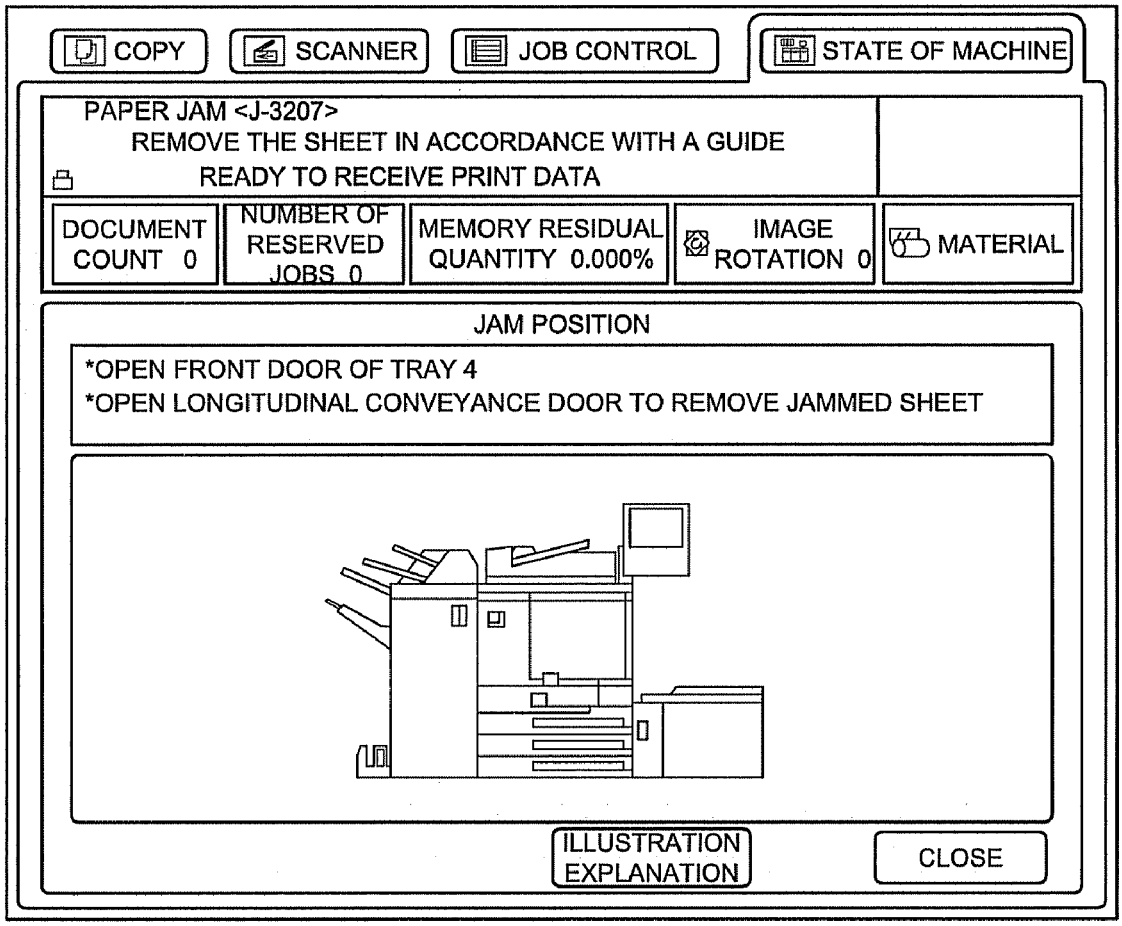
FIG. 6 is an illustration diagram showing an example of display of an operation display section of an image forming apparatus in the embodiment of the invention.

In this case, secondary-transferred toner is in existence on sheet 10, and the sheet 10 turns out to be in conditions to wind itself round fixing roller 1520*a* so that toner on the sheet 10 may stick to the fixing roller 1520*a*, as shown in FIG. 5(*a*). In this connection, in FIG. 5, dots on the surface on one side of sheet 10 represent toner schematically.

In this case, the control section 101 displays on operation display section 103 the message that informs a user of jam occurrence and a jam clearance method (step S301 in FIG. 3).

At this point in time when a user has removed the sheet in jam in accordance with the message (YES at step S302 in FIG. 3), toner of a toner image which was formed on a sheet is sticking to the fixing roller 1520*a* as shown in FIG. 5(*b*). If toner is staying on a surface of the fixing roller 1520*a*, the staying toner sticks to a sheet in the course of fixing in the succeeding image forming to cause image dirt.

Figure 7:
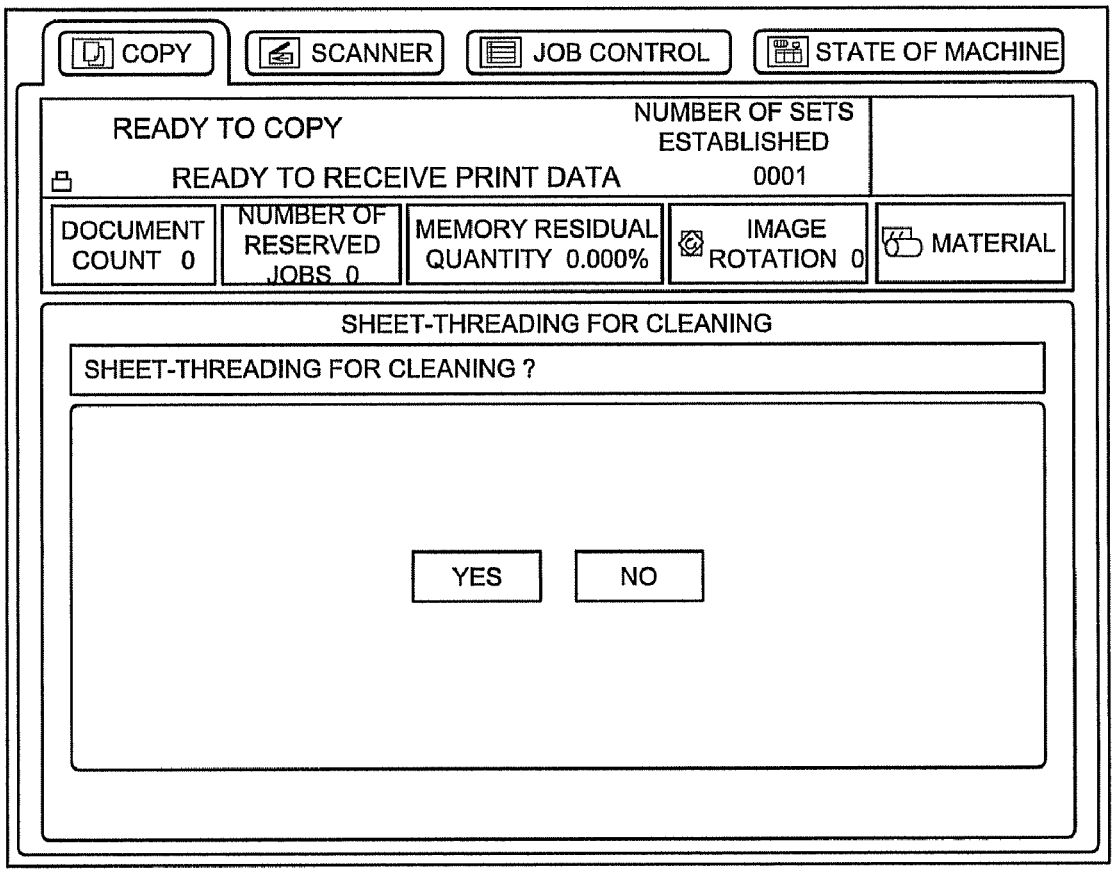
FIG. 7 is an illustration diagram showing an example of display of an operation display section of an image forming apparatus in the embodiment of the invention.

Therefore, the control section 101 displays a screen page for questions (FIG. 7) for inquiring of a user on operation display section 103 (step S303 in FIG. 3), concerning whether or not to practice a cleaning mode (see FIG. 5(*c*) to clean by moving toner sticking to fixing roller 1520*a* to a white sheet by conveying the white sheet having thereon no image to fixing unit 1520.

When the user selects "NO" for the screen page for questions (NO for step S304 in FIG. 3), practicing of a cleaning mode is canceled, and control section 101 terminates processing of the jam clearance program (END in FIG. 3) and returns to an ordinary image forming program.

Figure 4:
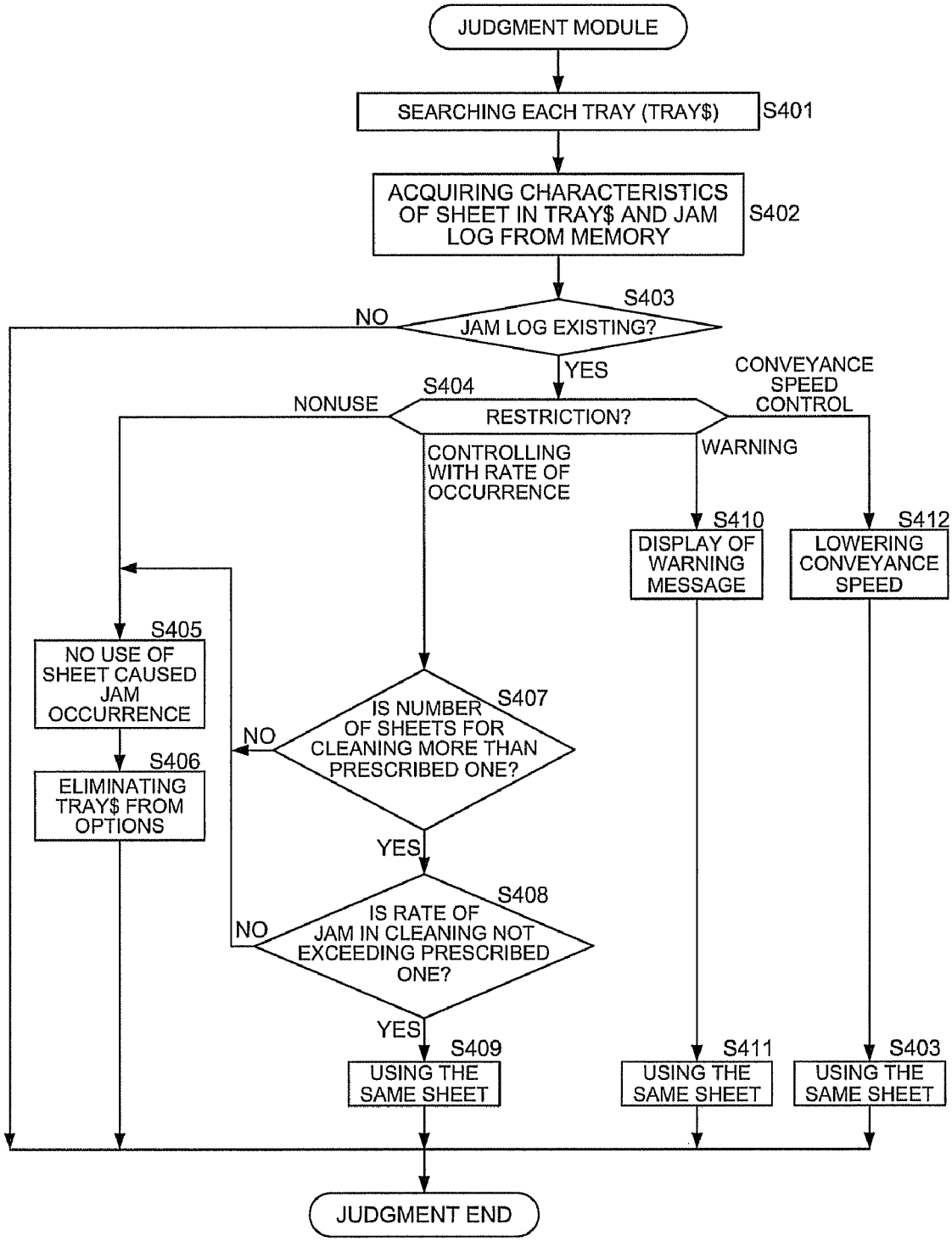
FIG. 4 is a flow chart showing operations of an image forming apparatus in the embodiment of the invention.

When the user selects "YES" for the screen page for questions (YES for step S304 in FIG. 3), control section 101 practices a judgment module to judge how to carry out the cleaning mode (step S305 in FIG. 3, FIG. 4).

In this case, as processing for the judgment module, the control section 101 searches each tray (tray $) (step S401 in FIG. 4), and acquires characteristics of the sheet in each tray (tray $) (at least one selected from surface characteristics, basis weight, grammage, material and a manufacturer) and jam log (jam records) in the cleaning mode for sheets in the tray in the past, from nonvolatile memory 102 (step S402 in FIG. 4).

Figures 11, 12:
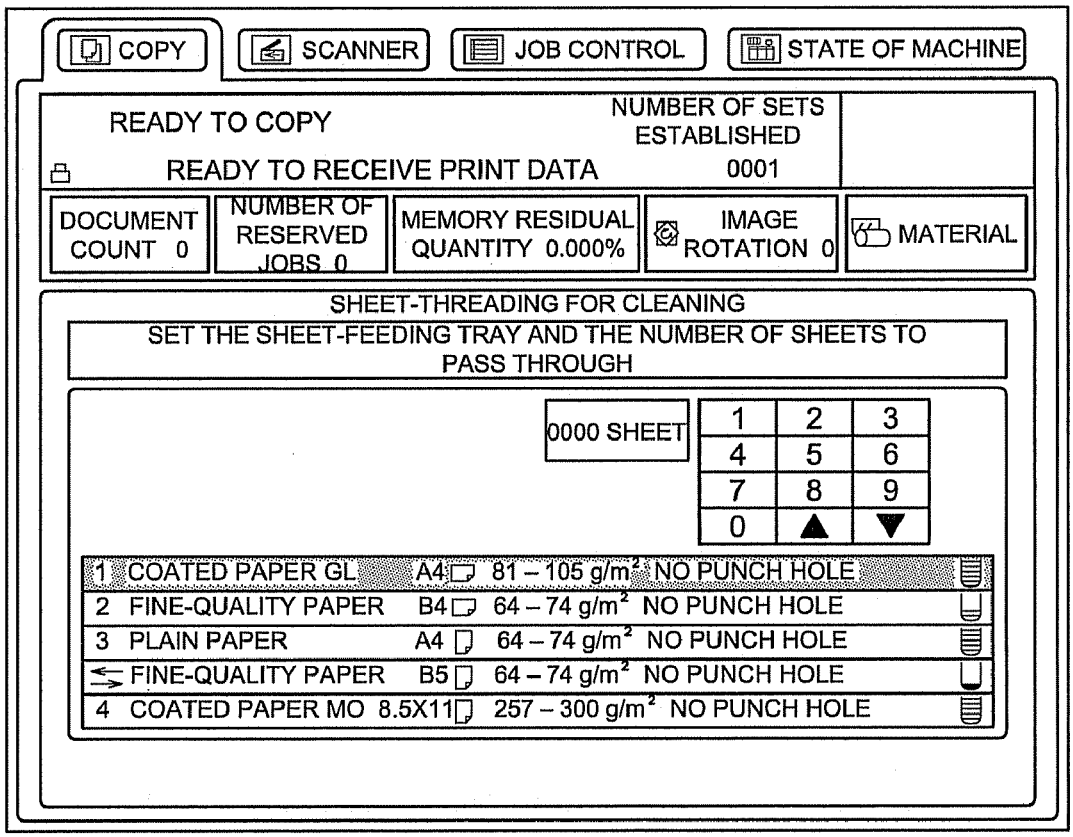
FIG. 11 is an illustration diagram showing operations of an image forming apparatus in the embodiment of the invention.
FIG. 12 is an illustration diagram showing an example of display of an operation display section of an image forming apparatus in the embodiment of the invention.

In this connection, as jam log in the cleaning mode, at least basis weight or grammage that means a weight of the sheet representing sheet characteristics, sheet types showing natures of the sheet such as plain paper, fine-quality paper and coated paper and the number of times of jam occurrence are recorded in nonvolatile memory 102 as a record in a matrix shape, as jam records in the case of practicing the leaning mode in the past, as shown in FIG. 11.

Further, in addition to the grammage and the sheet types, it is possible to leave, as jam log in a cleaning mode, the sheet materials, names of manufacturers, time of manufacturing and manufacturing lots, as sheet characteristics. In the meantime, at least one selected from grammage, a sheet type, material, a manufacturer, time of manufacturing and a manufacturing lot number and existence or nonexistence of jam occurrence can constitute jam log in a cleaning mode.

If the jam log in a cleaning mode has no record of jam in practicing cleaning mode in the past (NO at step S403 in FIG. 4), processing by judgment module is terminated (END in FIG. 4), because a judgment cannot be formed.

If the jam log in a cleaning mode has a record of jam in practicing cleaning mode in the past (YES at step S403 in FIG. 4), the restriction under which a cleaning mode is practiced is read out of nonvolatile memory 102 (step S404 in FIG. 4).

Figure 8:
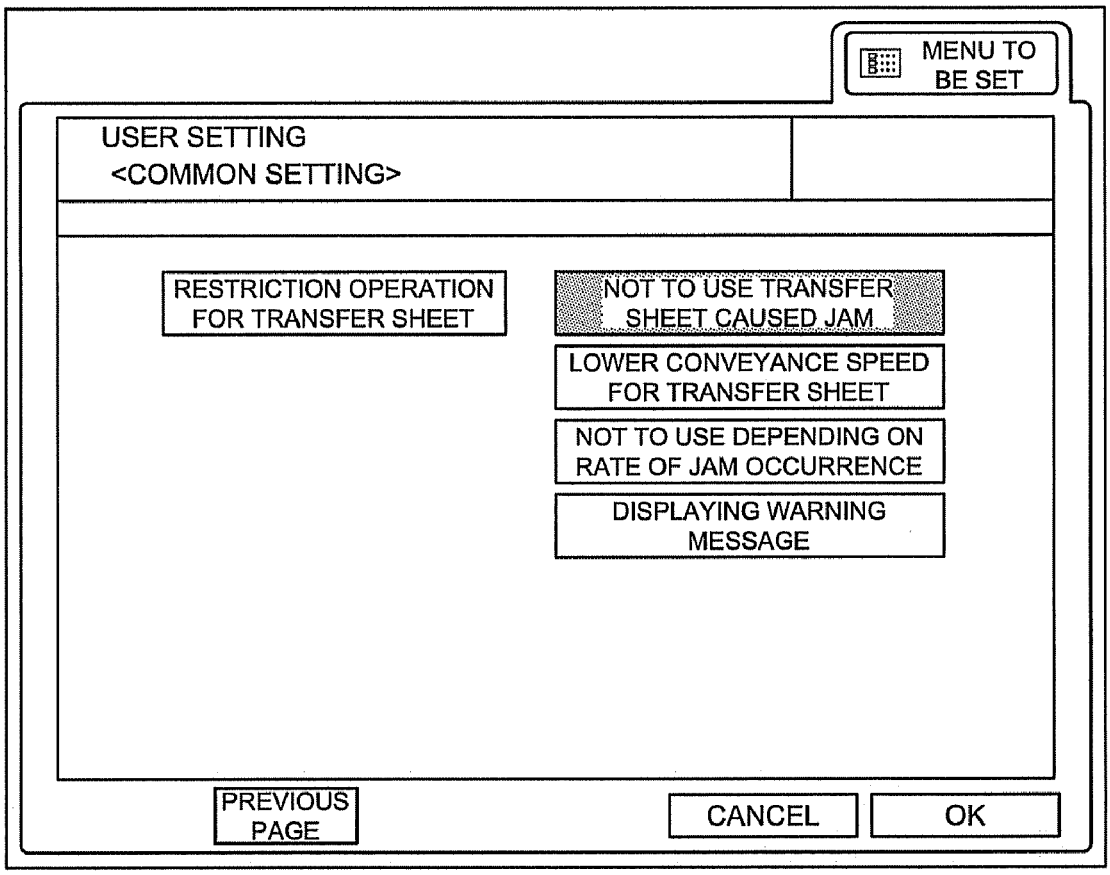
FIG. 8 is an illustration diagram showing an example of display of an operation display section of an image forming apparatus in the embodiment of the invention.

The restriction under which a cleaning mode is practiced is selected by a user in advance through an operation and display screen page shown in FIG. 8, and its selection is preserved by control section 101 on nonvolatile memory 102.

The restriction in this case includes selections such as "the sheet that caused jam occurrence in practicing cleaning cannot be used", "to use or not to use the sheet is determined depending on the rate of jam occurrence in the practice of cleaning", "the same sheet is used after a warning is given" and "to use after lowering the conveyance speed".

When "the same sheet cannot be used for practicing the cleaning mode" is established based on jam occurrence in practicing the cleaning mode in the past ("nonuse" at step S404 in FIG. 4), control section 101 conducts processing for eliminating tray$ having therein the sheet from options so that the tray$ cannot be used in the case of setting for practicing the cleaning mode (steps S405 and S406 in FIG. 4.

When "controlling based on the rate of jam occurrence in practicing a cleaning mode" is established based on the jam occurrence in practicing the cleaning mode in the past ("controlling based on rate of occurrence" at step S404 in FIG. 4), control section 101 examines whether the number of sheets used for practicing cleaning mode up to that moment is not less than the prescribed number of sheets or not (step S407 in FIG. 4).

In this case, the prescribed number of sheets means the number of sheets enough to obtain the results of calculation under the condition that an error is not so great, by calculating the rate of occurrence of jam in practicing the cleaning mode, and an example thereof is, for example, 20 sheets or more.

If the number of sheets used for practicing the cleaning mode in the past is the prescribed number of sheets or more (YES at step S407 in FIG. 4) and the rate of jam occurrence in practicing the cleaning mode is not more than the prescribed value (YES at step S408 in FIG. 4), sheets housed in tray $ are made to be usable (step S409 in FIG. 4).

The rate of occurrence of jam in practicing the cleaning mode, in this case, is "(number of times of jam occurrence in practicing a cleaning mode)/(number of sheets used in practicing a cleaning mode)". The rate of jam occurrence in practicing a cleaning mode which is a prescribed value means a value with which the jam occurrence in practicing a cleaning mode is not problematic, and an example thereof is 10%.

When the number of sheets used in practicing the cleaning mode up to that moment is less than the prescribed number of sheets (No at step S407 in FIG. 4), control section 101 conducts processing for eliminating tray$ housing that sheet from options so that the tray$ cannot be used in the case of setting for practicing the cleaning mode (steps S406 in FIG. 4).

If the rate of jam occurrence in practicing the cleaning mode exceeds the prescribed number (NO at step S408 in FIG. 4), control section 101 conducts processing for eliminating tray$ housing that sheet from options so that the tray$ cannot be used in the case of setting for practicing the cleaning mode (steps S406 in FIG. 4).

Further, when "using after giving a warning" is set ("warning" at step S404 in FIG. 4), control section 101 displays a warning screen page on operation display section 103 for a user (step S410 in FIG. 4), and makes the sheets housed in tray$ to be usable (step S411 in FIG. 4) This warning screen page is a screen page to notify users that the sheets in use have a possibility to have jam occurrence in practicing a leaning mode.

This warning screen page is made to be a warning display screen page by means of a message such as, for example, "the sheet of a "zzz" type having basis weight of not more than "yyy" g/m$^2$ has a possibility to have jam occurrence in practicing a cleaning mode.

When "using after lowering the conveyance speed" is established ("conveyance speed control" in step S404 in FIG. 4), control section 101 sets the conveyance speed for a sheet in practicing a cleaning mode to be a lower speed (step S412 in FIG. 4) and makes sheets housed in tray$ to be usable (step S413 in FIG. 4).

The lower speed for the conveyance speed in this case is, for example, a half of an ordinary conveyance speed, and it is also possible to arrange so that this conveyance speed is set by a user, or the conveyance speed is selected by a user from plural conveyance speeds (¼, ⅓, ½, ⅔ and ¾).

After completion of implementation of the aforesaid judgment module (step S305 in FIG. 3, step 401-step 413 in FIG. 4), control section 101 displays a screen page of setting a cleaning mode for a user on operation display section 103 (step S306 in FIG. 3), and implements setting of a cleaning mode corresponding to a parameter established by a user on the operation display section 103 (step S307 in FIG. 3).

On the screen page of setting cleaning mode, in this case, any one of respective options including "not to use a sheet identical to the sheet that caused a jam in the course of cleaning", "to use/not to use the same sheet depending on the rate of jam occurrence", "to use the same sheet by lowering the conveyance speed for the sheet" and "to use the same sheet after displaying a warning message" is displayed under the active state, corresponding to the results of judgment by the aforesaid judgment module, and other options are displayed under the non-active state. On the screen page of setting cleaning mode in FIG. 8, there is shown the state where the option of "not to use a sheet identical to the sheet that caused a jam in the course of cleaning" is under the active condition.

In this case, when it is recorded that a jam was caused on the sheet that is fine-quality paper and has a basis weight of "64-74 g/m$^2$" in jam log of cleaning mode in FIG. 11, "not to use a sheet identical to the sheet that caused a jam in the course of cleaning" can take any one of the modes including, not to use the sheet that is fine-quality paper and has a basis weight of "64-74 g/m$^2$", not to use a sheet representing fine-quality paper independently of a basis weight and not to use a sheet with a basis weight of "64-74 g/m$^2$ independently of a sheet type.

Figure 9:
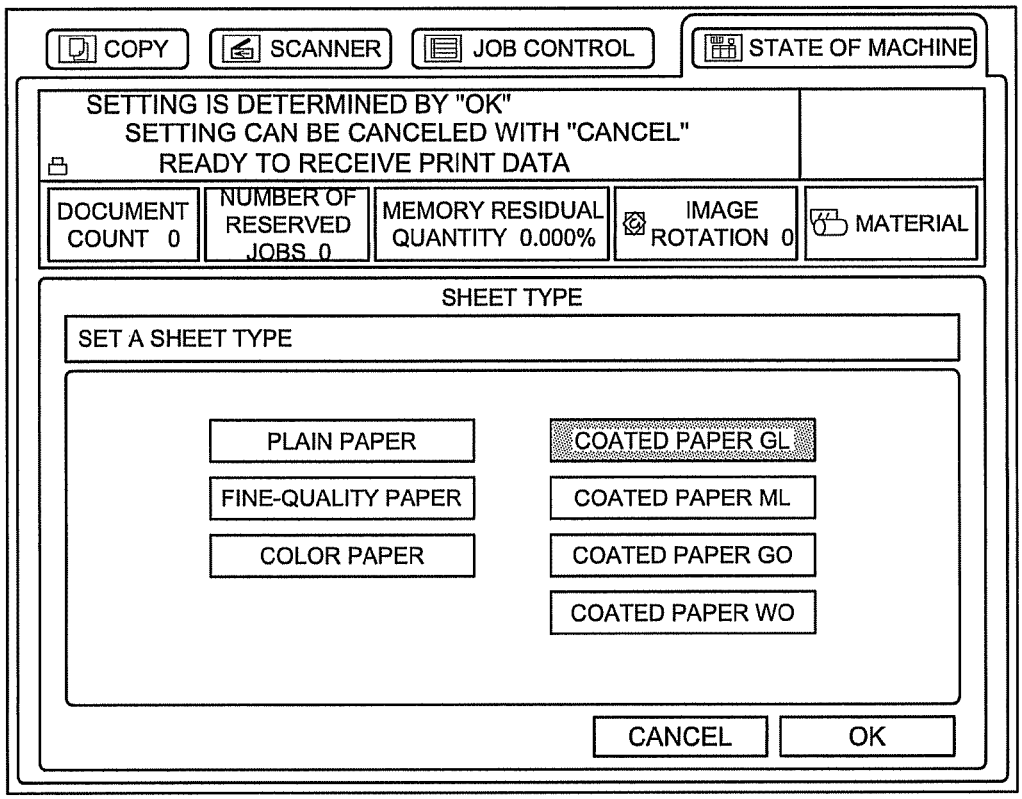
FIG. 9 is an illustration diagram showing an example of display of an operation display section of an image forming apparatus in the embodiment of the invention.
Figure 10:
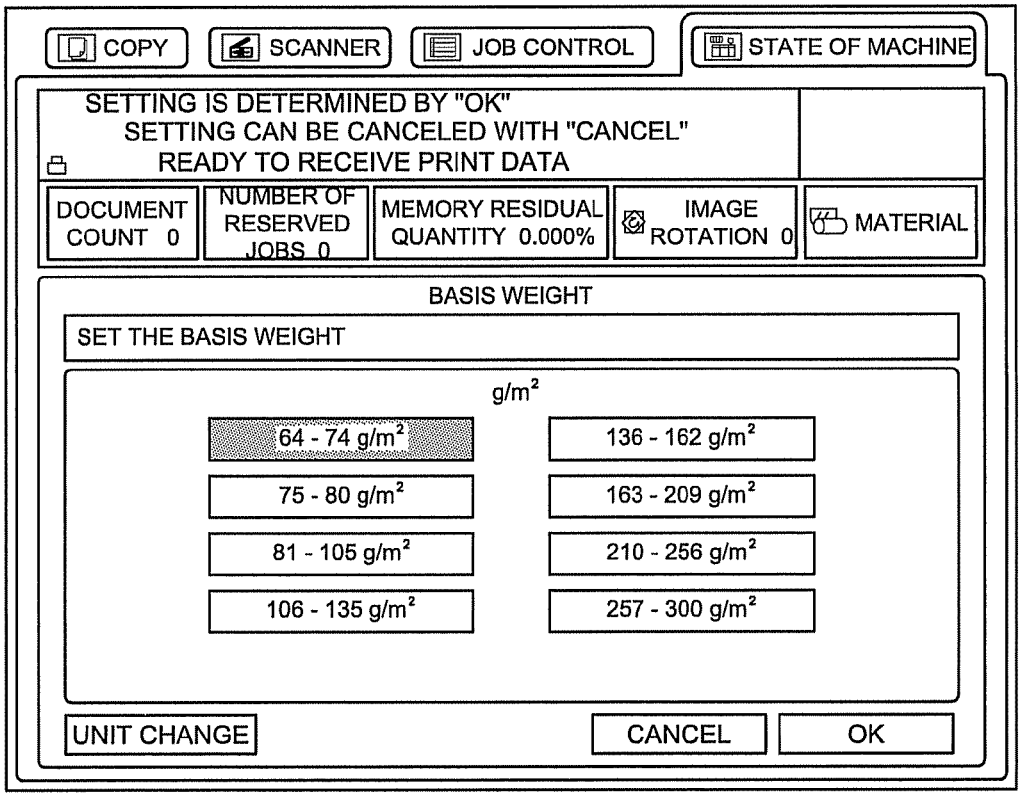
FIG. 10 is an illustration diagram showing an example of display of an operation display section of an image forming apparatus in the embodiment of the invention.

In this case, if usable sheets are in existence in some tray when conducting cleaning with a sheet other than sheets prohibited in terms of use, control section 101 may determine, or a user may determine through operation screen pages in FIGS. 9 and 10 In this case, the determination of control section 101 may be approved by a user while the determination is displayed. It is further possible for a user to set through an operation screen page within a feasible range, separately from the determination of control section 101 that is displayed.

Further, in FIG. 8, when "to use after lowering the conveyance speed" is under the active condition, it is also possible to arrange so that a user may designate specific speeds such as ¾, ⅓, ½ and ⅓ of the lowered conveyance speed, from the operation screen page owing to this, fixability is improved, and releasability is improved because wax contained in toner oozes out to the surface, thus, occurrence of jam caused by the sheet of the same type that tends to cause a jam.

Further, at a point of time when setting of the above cleaning mode is completed, control section 101 displays a screen page for setting the number of sheets to be used for cleaning on operation display section 103. By using this screen page, a user sets the number of sheets to be used for cleaning, and when a start button is pressed (YES at step S308 in FIG. 3), if practice of cleaning is possible (YES at step S309 in FIG. 3), control section 101 practices a cleaning mode (step S310 in FIG. 3). If there is some item in the aforesaid setting where the practice is impossible or is inappropriate (NO at step S309 in FIG. 3), control section 101 urges a user to set again by returning to the screen page of impossible setting or inappropriate setting (step S307 in FIG. 3).

In this case, control section 101 conveys a sheet established in the aforesaid way toward fixing unit 1520 without forming an image on the sheet, to carry out cleaning by moving toner sticking to fixing roller 1520*a* to the white sheet (see FIG. 5(*c*)).

Control section 101 monitors occurrence of sheet jam even in the course of practicing the cleaning (step S311 in FIG. 3), and when no jam occurs (No at step S311 in FIG. 3), the control section 101 displays a screen page inquiring restarting of cleaning (see FIG. 3) on operation display section 103.

If toner is still sticking to a white sheet even when cleaning with prescribed number of sheets is practiced in this case, it is considered that toner on the fixing roller is not removed thoroughly, therefore, it is preferable that cleaning is continued by a desire of a user. Therefore, if an instruction for restarting of cleaning is inputted in operation display section 103 by a user (YES at step S316 in FIG. 3), control section 101 repeats the practice of cleaning (step S310 in FIG. 3).

On the other hand, if toner stops sticking to the white sheet outputted by the practice of a cleaning mode, toner on the fixing roller is considered to be removed, thus, cleaning may be terminated by judgment of a user. Namely, if an instruction of no restarting of cleaning by a user is indicated from operation display section 103 (NO at step S316 in FIG. 3), control section 101 terminates processing of a cleaning mode (END in FIG. 3).

Then, when the sheet winds itself around fixing roller 1520*a* as shown in FIG. 5(*d*) in the course of practicing cleaning to cause fixing jam (YES at step S311 in FIG. 3), control section 101 records, in a volatile memory, the characteristics (basis weight and sheet types) of the sheet that has caused fixing jam, with occurrence of fixing jam in the course of practicing cleaning serving as jam log of a cleaning mode (step S312 in FIG. 3).

In this case, control section 101 displays a message to notify a user of jam occurrence and a jam clearance method, on operation display section 103. At a point of time when a user has removed the sheet that caused jam occurrence following the message (YES at step S302 in FIG. 3), the control section 101 practices judgment module that judges how to implement a cleaning mode (step S314 in FIG. 3, FIG. 4).

Namely, jam log of a cleaning mode updated by jam occurrence in the course of practicing cleaning mode this time and restriction information showing the restriction under which the cleaning mode is practiced are read out of nonvolatile memory 102.

In this case, if there is a restriction to the effect of using no sheet caused jam in the course of practicing a cleaning mode, the control section 101 determines a sheet to be used in practice of a cleaning mode, based on the rate of occurrence of jam that changes corresponding to the jam this time.

Further, if there is a restriction to the effect of to use/not to use the same sheet depending on the rate of jam occurrence, the control section 101 determines a sheet to be used in practice of a cleaning mode, based on the rate of occurrence of jam that changes corresponding to the jam this time.

In this connection, when determination of a user is needed in occasions such as an occasion where a sheet determined by judgment of a judgment module does not exist in some tray, and an occasion where plural options of sheets are in existence in judgment module, the control section 101 displays a screen page of setting a cleaning mode for a user on operation display section 103 (step S306 in FIG. 3), and implements setting of a cleaning mode corresponding to a parameter established by a user on the operation display section 103 (step S307 in FIG. 3), considering that practice of cleaning mode cannot be restarted (NO at step S315 in FIG. 3).

When a sheet used in practice of cleaning mode is determined by this judgment module (step S314 in FIG. 3) and the determined sheet is in existence in some tray, a screen page for inquiring whether or not to restart a cleaning mode in FIG. 3 is displayed by control section 101 on operation display section 103 (step S316 in FIG. 3), considering that practice of cleaning mode can be restarted (YES at step S315 in FIG. 3).

Figure 13:
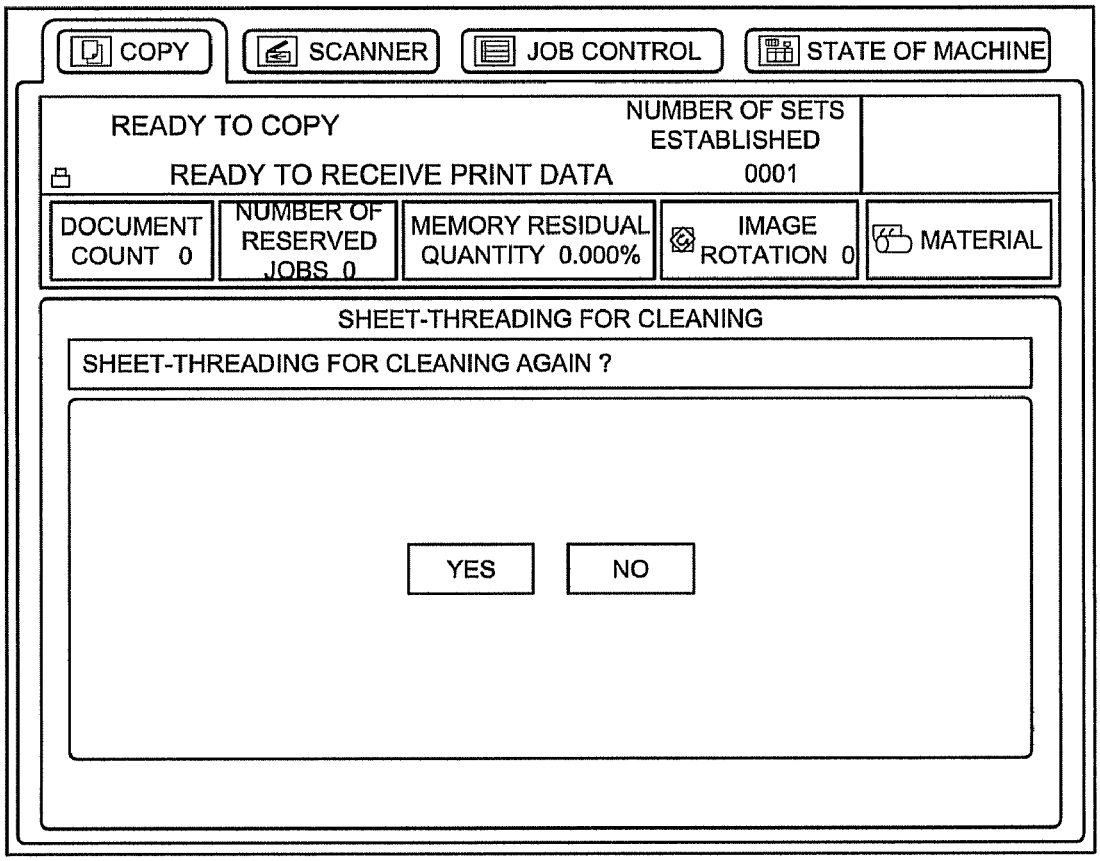
FIG. 13 is an illustration diagram showing an example of display of an operation display section of an image forming apparatus in the embodiment of the invention.

If toner is still sticking to a white sheet that is outputted by practice of cleaning mode in this case, it is preferable that the cleaning is continued by a desire of a user, because it is considered that toner on a fixing roller is not removed thoroughly. Namely, if an instruction for restarting cleaning ("YES" in FIG. 13) is inputted by a user in operation display section 103 (YES at step S316 in FIG. 3), control section 101 repeats practice of cleaning (step S310 in FIG. 3).

On the other hand, if toner is not sticking to a white sheet that is outputted by practice of cleaning mode, cleaning may be terminated by judgment of a user, because it is considered that toner on a fixing roller is removed. Namely, if an instruction for restarting no cleaning ("NO" in FIG. 13) is inputted by a user in operation display section 103 (NO at step S316 in FIG. 3), control section 101 terminates processing of a cleaning mode (END in FIG. 3).

Second Embodiment

In the First Embodiment, control section 101 started practice of a cleaning mode, by receiving setting by a user through display of the screen page of setting cleaning mode (step S306 in FIG. 3) and setting of a cleaning mode (step S307 in FIG. 3), after the judgment module (step S305 in FIG. 3).

In contrast to this, when selection of a feasible sheet is determined by judgment module (step S305 in FIG. 3), control section 101 may omit display of a screen page of setting a cleaning mode (step S306 in FIG. 3) and setting of a cleaning mode (step S307 in FIG. 3) to practice a cleaning mode. In this case, when selection of a feasible sheet cannot be determined by judgment module (step S305 in FIG. 3), control section 101 may practice a cleaning mode after passing through display of a screen page of setting a cleaning mode (step S306 in FIG. 3) and setting of a cleaning mode (step S307 in FIG. 3).

Third Embodiment

In the aforesaid embodiments, records of jam in the case of practicing a cleaning mode have been kept as jam log for the cleaning mode on the basis of grammage and sheet types. However, it is also possible to keep characteristics of the sheet such as sheet material, manufacturers, manufacturing time and manufacturing lot numbers as jam log for cleaning mode, in addition to the grammage and sheet types.

In this case, when it is considered that a jam in the case of practicing a cleaning mode takes place for the sheet manufactured by a specific manufacturer independently of basis weight or grammage, for example, it is possible to take actions such as forbidding the use of all sheets of that manufacturer in the case of practicing the cleaning mode, lowering the speed and warning. Therefore, the control section 101 can change the state of restriction, depending on the situation judged from characteristics of the sheet recorded with cleaning mode jam log.

Fourth Embodiment

In the aforesaid embodiments, restrictions (forbidding the use, warning, lowering the speed and using depending on the rate of jam occurrence) were placed on the sheet which is the same as that having caused jam occurrence in the course of cleaning. However, it is also possible to place restrictions on the sheet that is the same as or is thinner than the sheet having caused jam occurrence.

In the first invention stated above, a sheet which is the same in terms of a type as the sheet having caused a sheet jam in the past is not used, which makes it possible to obtain effects that sheet jam occurrence caused by the sheet of the same type which easily causes jam occurrence is controlled and decline of productivity of an image forming apparatus is eliminated.

In the second invention, a sheet which is the same in terms of a type as the sheet having caused a sheet jam in the past is lowered surely in terms of its conveyance speed, thus, fixability is improved, and releasability is improved because wax contained in toner oozes out to the surface, thereby, sheet jam occurrence caused by the sheet of the same type which easily causes jam occurrence is controlled, and decline of productivity if an image forming apparatus is eliminated.

What is claimed is:

1. An image forming apparatus which forms an image on a sheet, comprising:

an image forming section that forms a toner image on a plurality of sheet types;

a fixing unit in which the toner image formed by the image forming section is fixed on the plurality of sheet types by a fixing member;

a memory section that stores characteristics of the plurality of sheet types; and a control section that controls conveyance of the plurality of sheet types, wherein the control section has a cleaning mode in which after the sheet is conveyed to the image forming section from a sheet-supplying tray, the control section controls the image forming section not to form the toner image on the sheet, and controls the sheet to be conveyed to the fixing unit, after which the control section controls the cleaning mode to clean the fixing member by removing toner sticking to the fixing member, and when sheet jamming is caused at the fixing unit while the cleaning mode is practiced, the control section stores at least one characteristic of a sheet that causes the first sheet type jamming into the memory section, and when a succeeding cleaning mode is practiced, the control section prohibits selection of the first sheet type having the characteristic stored in the memory section, and selects a second sheet type having other characteristics to practice the cleaning mode.

2. The image forming apparatus of claim 1, wherein the characteristic to be stored of the first sheet type that causes the sheet jamming is at least one selected from surface characteristics, basis weight, materials and manufacturers of the first sheet type.

3. An image forming apparatus which forms an image on a sheet, comprising:

an image forming section that forms a toner image on a sheet type;

a fixing unit in which the toner image formed by the image forming section is fixed on the sheet type by a fixing member;

a memory section that stores characteristics of the sheet type; and a control section that controls conveyance of the sheet type, wherein the control section has a cleaning mode in which after the sheet is conveyed to the image forming section from a sheet-supplying tray, the control section controls the image forming section not to form the toner image on the sheet, and controls the sheet to be conveyed to the fixing unit, after which the control section controls the cleaning mode to clean the fixing member by removing toner sticking to the fixing member, and when sheet jamming is caused at the fixing unit while the cleaning mode is practiced, the control section stores at least one characteristic of the sheet type that caused the sheet jamming into the memory section, and when the sheet type having the characteristic stored in the memory section is selected, the control section controls the sheet to be conveyed to the fixing unit at a conveyance speed that is lower than a standard conveyance speed.

4. The image forming apparatus of claim 3, wherein the characteristic of the sheet type that caused the sheet jamming is at least one selected from surface characteristics, basis weight, materials and manufacturers of the sheet type.

* * * * *